United States Patent [19]

Bakken

[11] Patent Number: 4,545,079

[45] Date of Patent: Oct. 8, 1985

[54] WAITRESS APRON

[76] Inventor: Paula S. Bakken, 26071 Dow, Redford, Mich. 48239

[21] Appl. No.: 600,793

[22] Filed: Apr. 16, 1984

[51] Int. Cl.[4] ..... A41B 13/10; A41D 27/20

[52] U.S. Cl. ..... 2/48; 2/247

[58] Field of Search ..... 2/48, 49, 50, 51, 52, 2/250, 253, 254, 247

[56] References Cited

U.S. PATENT DOCUMENTS 1,513,513 10/1924 London ..... 2/48

3,115,639 12/1963 Moszczunski ..... 2/48

*Primary Examiner*—Doris L. Troutman

*Attorney, Agent, or Firm*—Barnes, Kisselle, Raisch, Choate, Whittemore & Hulbert

[57] ABSTRACT

A waitress apron which includes front and back panels fastened to each other to provide a pair of recesses or pockets, and a rectangular third panel fastened around three edges to the back panel within one of such pockets, the fourth edge being removably secured to the back panel by hook-and-loop pressure/contact fastening means and hidden from view externally of the apron.

2 Claims, 3 Drawing Figures

FIG. 1
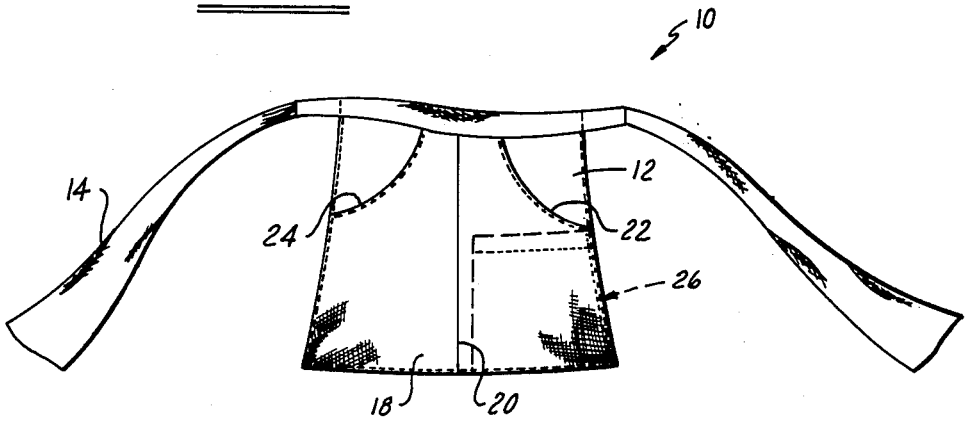
FIG. 2
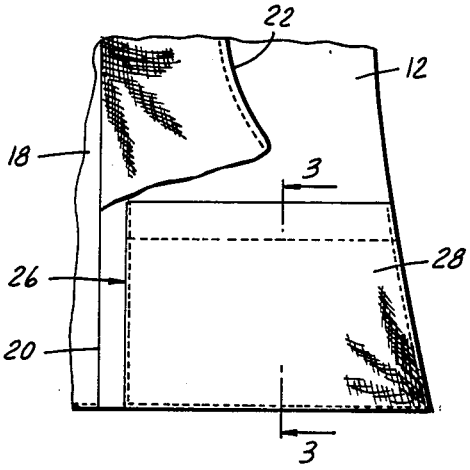
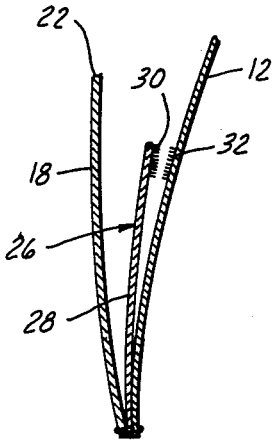
FIG. 3

WAITRESS APRON

The present invention is directed to aprons, and more particularly to an apron adapted to be worn by a waitress or the like.

A problem encountered by many waitresses is the inability or inconvenience of carrying personal valuables such as money, credit cards or jewelry. It is not always convenient or advisable to leave valuables in lockers or the like. It is important to keep such materials separate from house or customer money, so placing valuables in the usual apron pockets is not usually appropriate. Furthermore, apron pockets are usually provided with wide openings to facilitate insertion or removal of material. As a consequence, bills and change tend to fall therefrom, particularly when the waitress assumes a sitting or squatting position.

It is an object of the present invention to provide an apron which is economical to manufacture and which possesses a hidden or secret recess or pocket which will remain closed during normal use but which may be readily and quickly opened to insert or remove materials from therewithin.

The invention, together with additional objects, features and advantages thereof, will be best understood from the following description, the appended claims and the accompanying drawing in which:

FIG. 1 is a perspective view of a waitress apron which embodies the subject matter of the invention;

FIG. 2 is a fragmentary partially sectioned view on an enlarged scale of a portion of FIG. 1 which illustrates the subject matter of the invention in greater detail; and FIG. 3 is a fragmentary sectioned view taken substantially along the line 3—3 in FIG. 1.

Referring to the drawing, the waitress apron 10 illustrated therein comprises a generally rectangular main or primary panel 12 from one longitudinal edge of which a pair of apron strings 14,16 oppositely and integrally project. A front panel 18, which is generally identical to back panel 12, is stitched or otherwise fastened thereto about its periphery and along the vertical centerline at 20 (the term "vertical" referring to its normal orientation in use). The upper side corners of panel 18 are arcuately trimmed, with the resulting edges 22,24 being unattached to panel 12 so as to form access openings to the recesses or pockets formed by panels 18,12 and stitch line 20. To the extent thus far described, apron 10 is generally conventional.

In accordance with the present invention, a secret or hidden pocket 26 is disposed within the recess or pocket between panels 12,18 beneath edge 22 (and/or beneath edge 24). Pocket 26 comprises a rectangular material section or panel 28 stitched or otherwise fastened to rear panel 12 along the side and bottom edges of panel section 28. Note in FIG. 2 that the bottom and one side edge of section 28 are sandwiched between fastened edges of panels 12,18, while the other side edge of section 28 is spaced from partitioning stitch line 20. The upper edge of section 28 is beneath arcuate edge 22, section 28 thus being entirely invisible from externally of apron 10.

Complementary strips or sections 30,32 of pressure/-contact hook-and-loop fastening means, such as VELCRO (trademark) fastening means, are affixed to the upper inside edge of section 28 and to the opposing surface of panel 12, and extend for the entire width of section 28. Thus, fastening strips 30,32 normally firmly closes pocket 26 along the entire upper edge thereof. However, the pocket may be readily opened with one hand to insert or remove material therefrom, after which the pocket will close itself. This automatic closure feature, which results from use of a contact/pressure fastener, would not inhere in fasteners such as snaps or zippers.

The invention claimed is:

1. A waitress apron comprising generally rectangular front and back panels affixed to each other along lower and opposed lateral side edges and along the lateral centerline, at least a portion of the upper edge of said front panel being unattached to said back panel so as to afford access to recesses formed between said front and back panels, apron strings oppositely and integrally projecting from the longitudinal upper edges of said front and back panels, a third rectangular panel positioned between said front and back panels and affixed to said back panel along side and bottom edges of said third panel, the upper edge of said third panel being disposed beneath said unattached portion of said front panel so as to be hidden beneath said front panel, and pressure/contact fastening means disposed along said upper edge of said third panel across the entire width thereof and along the opposing surface of said back panel.

2. The apron set forth in claim 1 wherein said pressure/contact fastening means comprises hook-and-loop fastening strips affixed to said back and third panels.

* * * * *